United States Patent [19]

Kasuda

[11] Patent Number: 4,987,843

[45] Date of Patent: Jan. 29, 1991

[54] UPPER FEED ADJUSTING MECHANISM FOR SEING MACHINE

[75] Inventor: Takashi Kasuda, Osaka, Japan

[73] Assignee: Pegasus Sewing Machine Co., Ltd., Osaka, Japan

[21] Appl. No.: 279,559

[22] Filed: Dec. 2, 1988

[30] Foreign Application Priority Data

Jan. 29, 1988 [JP] Japan ..... 63-20483

[51] Int. Cl.[5] ..... D05B 27/04

[52] U.S. Cl. ..... 112/320; 112/311; 112/314

[58] Field of Search ..... 112/320, 311, 314

[56] References Cited

U.S. PATENT DOCUMENTS

| | | | |
|---|---|---|---|
| 2,967,498 | 1/1961 | Russell et al. | 112/314 X |
| 4,285,294 | 8/1981 | Aida . | |
| 4,503,794 | 3/1985 | Ishihara et al. . | |
| 4,589,364 | 5/1986 | Yamamoto et al. . | |
| 4,616,586 | 10/1986 | Scholl | 112/311 |
| 4,759,304 | 7/1988 | Nava et al. . | |

FOREIGN PATENT DOCUMENTS

| | | |
|---|---|---|
| 58-169862 | 11/1983 | Japan . |
| 60-5190 | 1/1985 | Japan . |
| 60-12521 | 4/1985 | Japan . |
| 60-227795 | 11/1985 | Japan . |
| 61-16473 | 4/1986 | Japan . |
| 63-33878 | 7/1988 | Japan . |

*Primary Examiner*—Andrew M. Falik

*Attorney, Agent, or Firm*—Flynn, Thiel, Boutell & Tanis

[57] ABSTRACT

An upper feed mechanism of a sewing machine, in which a horizontal motion mechanism for moving the upper feed dog back and forth is provided with a double lever mechanism composed of a single arm lever, a bifurcate lever and a slider slidably mounted on both levers, and a crank lever mechanism for oscillating the levers. When a crank of the crank lever mechanism is at a top dead point or a bottom dead point, the radial directions of the levers are matched, and when the slider is moved in this state, the upper feed dog varies in the feed amount while the front position or rear position is constant. When a rod for coupling the crank and lever of the crank lever mechanism is pivotally mounted in one of two positions spaced in the peripheral direction with respect to the lever, the upper feed dog fitted and disposed at the presser foot makes an upper feed motion before the needle drop point, and when the rod is mounted in the other position the upper feed dog disposed behind the presser foot makes an upper feed motion behind the needle drop point.

8 Claims, 4 Drawing Sheets

UPPER FEED ADJUSTING MECHANISM FOR SEING MACHINE

BACKGROUND OF THE INVENTION

1. Field of the Invention

This invention relates to an upper feed mechanism of a sewing machine, and more particularly to an upper feed mechanism of a sewing machine including an upper feed dog for making upper, lower, right and left motions by means of a main shaft, and feeding a cloth in cooperation with a lower feed dog.

2. Description of the Prior Art

The upper feed mechanism of a sewing machine is available in various types. One type comprises a crank oscillating back and forth by means of a main shaft, an upper feed bar of which a base part is rotatably mounted on the crank to oscillate up and down, having an upper feed dog opposing a lower feed dog disposed at a free end of the upper feed bar, a spring device for operating to push down the upper feed bar, and another crank oscillating vertically by means of the main shaft and moving the upper feed bar up and down in cooperation with the spring device. Another type comprises a crank oscillating back and forth by means of a main shaft, another crank oscillating up and down by means of the main shaft, an upper feed bar of which one end is coupled with the crank for horizontal feed by way of a first link and other end is provided with an upper feed dog opposing a lower feed dog, a second link coupling the middle part of the upper feed bar and the crank for vertical feed, a lever rotatably pivoted on the sewing machine frame, a third link coupling the lever and the pivotal part joining the first link and upper feed bar, and a pressure spring intervening between the lever and the sewing machine frame (see Japanese Laid-open Patent No. 60-227795). Moreover, as for the upper feed dog, a type of feeding upward as being fitted and disposed at the presser foot before the needle drop unit (hereinafter called front upper feed), and a type of feeding upward as being disposed at the rear side of the presser foot behind the needle drop point (rear upper feed), and the former front upper feed is suited to sewing a thin fabric which is easily deviated or subjected to ruffling, while the latter rear upper feed is suited to sewing denim or other thick and heavy fabric and is capable of feeding the cloth smoothly.

The conventional upper feed mechanism of a sewing machine also usually comprises an adjusting device for the upper feed amount within the mechanism for moving the crank for horizontal feed back and forth by means of the main shaft. This adjusting device is, in most cases, composed of an arc-shaped lever, a slider being slidably mounted on this lever and positioned by the operation of an operating mechanism, a crank for oscillating the lever, and a link for coupling the crank and slider, and it is composed so that the pivotal point of the link and crank may be matched with the center of the curvature of the lever, and the upper feed amount is designed to be changed while the rear position is constant in the front upper feed type or the front position is constant in the rear upper feed type.

A different version of the upper feed mechanism of a sewing machine comprises, for example, an adjusting mechanism for the vertical motion within a mechanism for moving the crank for vertical feed up and down by means of the main shaft, so that the vertical motion of the upper feed dog may be adjusted depending on the thickness of the fabric or stepped part (see Japanese Laid-open Utility Model No. 58-169862).

This invention is intended to exchange the upper feed dog for front upper feed and the upper feed dog for rear upper feed depending on the application so as to use the front upper feed and rear upper feed separately, but in the conventional upper feed mechanism if only the upper feed dogs were exchanged, the upper feed dog might collide with the presser foot when the upper feed amount was changed. In other words, in the sewing machine of front upper feed, if the upper feed dog is merely changed in position to behind the needle drop point, the rear position is constant and the upper feed amount changes, and therefore if the upper feed amount is increased, the upper feed dog may collide against the presser foot if moved to the front side. In the sewing machine of a rear upper feed type, similarly, when the upper feed amount is increased while the front position is constant and the upper feed amount is changed, the upper feed dog may collide with the presser foot upon completion of the cloth feed.

SUMMARY OF THE INVENTION

It is hence a primary object of this invention to solve the above-discussed problems, and provide an upper feed mechanism for a sewing machine capable of easily changing the mode of upper feed depending on the sewing condition when sewing a fabric.

To achieve the above object, this invention provides an upper feed mechanism comprising an upper feed bar, a horizontal motion mechanism coupled with the upper feed bar to move the upper feed bar back and forth by means of a main shaft, and a vertical motion mechanism for oscillating the upper feed bar up and down by means of the main shaft, wherein an upper feed dog for front upper feed or rear upper feed is detachably mounted to one end of the upper feed bar. The horizontal motion mechanism is provided with a crank lever mechanism composed of a crank rotated and driven by the main shaft, a lever pivoted oscillatably, and a rod coupled between the crank and lever so as to oscillate the lever by the rotation of the crank, and with a transmission mechanism for transmitting the lever oscillation to the upper feed bar. This transmission mechanism contains in itself an upper feed amount adjusting device capable of adjusting the upper feed amount without moving the upper feed dog when the upper feed dog is located at the front position or rear position, and furthermore, the rod of the crank lever mechanism is changed over and linked to a first position when the upper feed dog is for front upper feed and to a second position when it is for rear upper feed with the first and second positions having a defined interval in the peripheral direction of the lever.

By changing the position at which the rod is coupled to the lever, the front upper feed and rear upper feed can be selectively used, and the upper feed amount may be varied while the front position is constant or the rear position is constant.

DESCRIPTION OF THE PREFERRED EMBODIMENT

Figure 2:
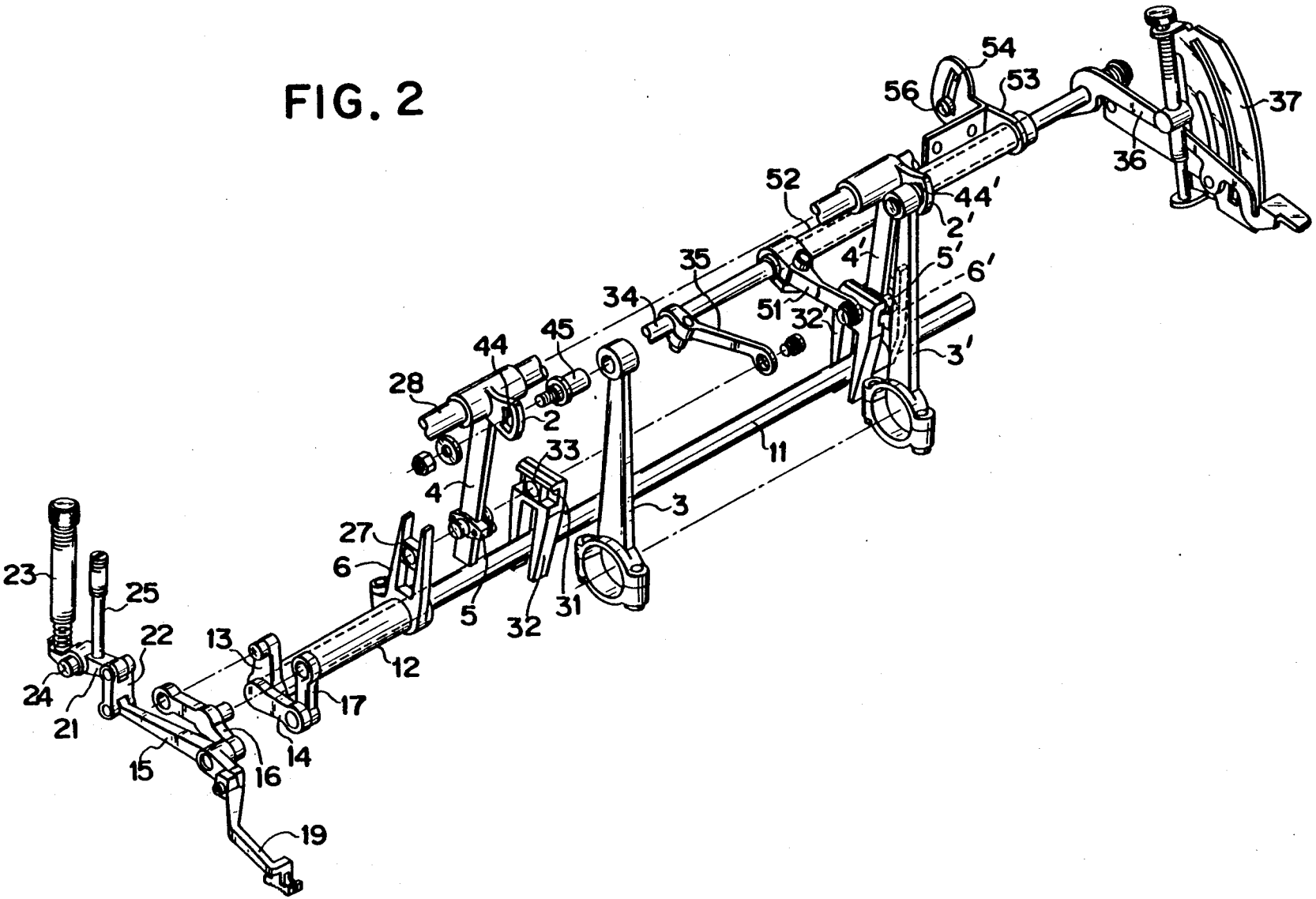
FIG. 2 is an exploded perspective view of the upper feed mechanism shown in FIG. 1.
Figure 3:
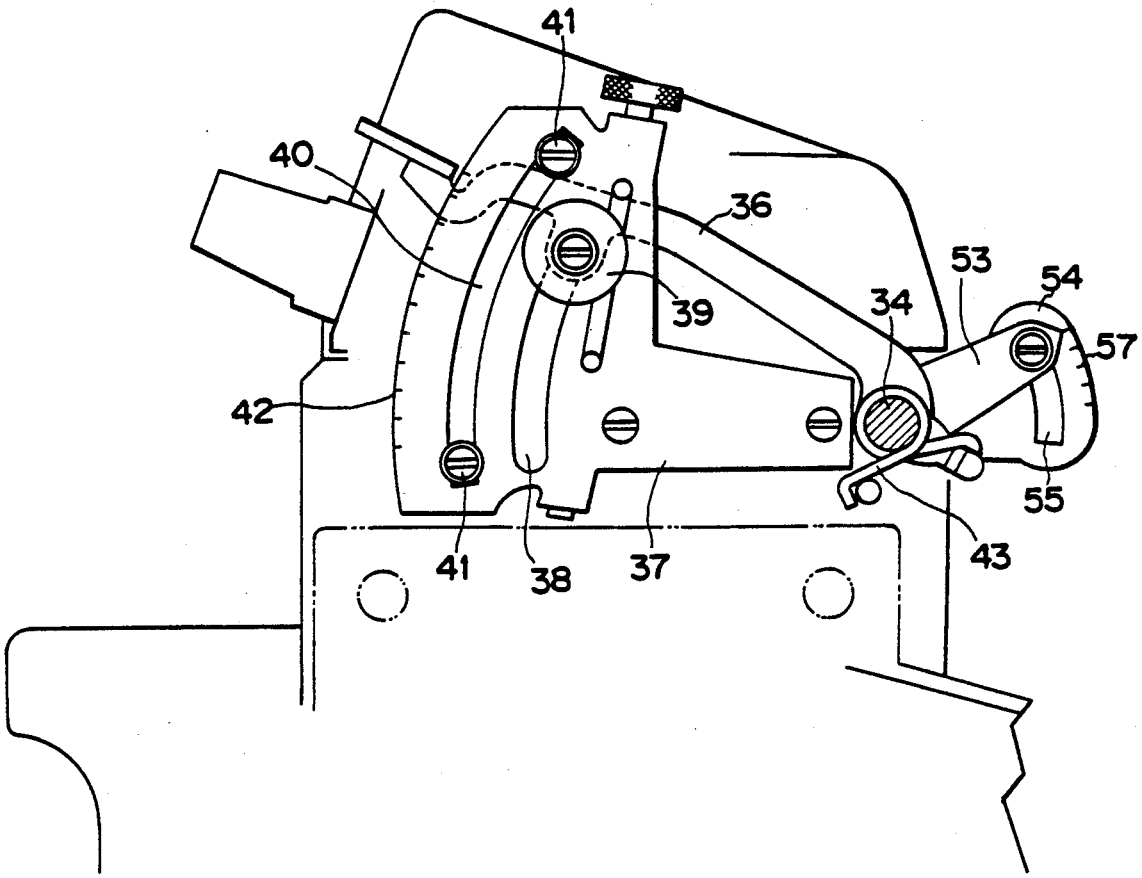
FIG. 3 is a side elevation of the sewing machine.

Referring first to FIG. 2, a tubular shaft 12 is rotatably fitted over one end of an oscillating shaft 11 to make up a double shaft structure. A crank 13 for horizontal feed is affixed to one end of the tubular shaft 12 and a crank 14 for vertical feed is affixed to the shaft end of an oscillating shaft 11 projecting from crank 13. One end of a lever 16, of which the other end is pivotally mounted on the middle part of an upper feed bar 15, is coupled to the crank 13 for horizontal feed, while its middle part is coupled to the crank 14 for vertical feed by means of a intermediate link 17.

Figure 1:
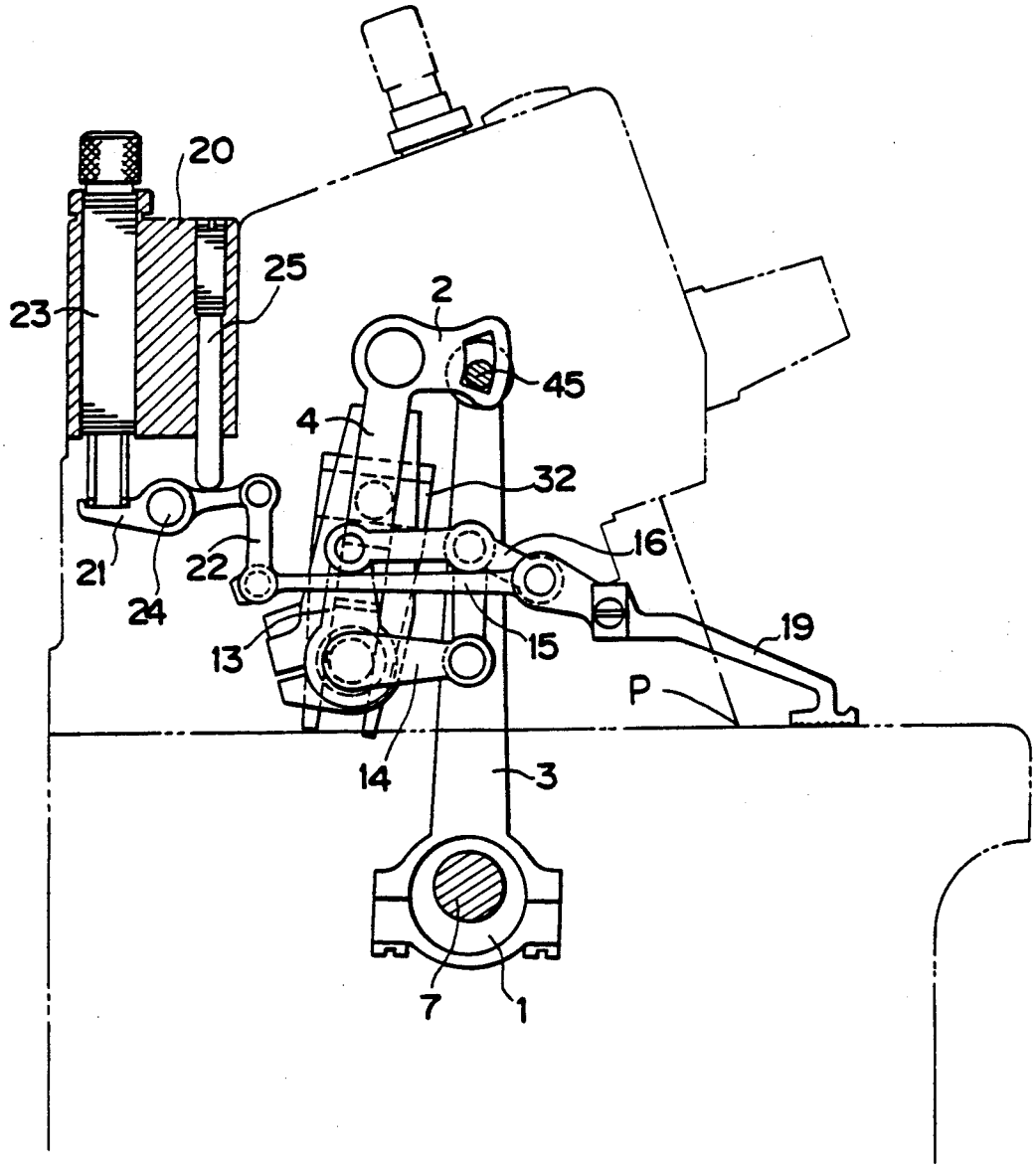
FIG. 1 is a side elevation showing a part of an upper feed mechanism of a sewing machine of this invention in a sectional view.

On the upper feed bar 15, an upper feed dog 19 for front upper feed or an upper feed dog for rear upper feed is detachably mounted at a free end thereof, and a base end of the upper feed bar is coupled to one end of a lever 21 by a link 22. A middle part of lever 21 is pivoted on a machine frame 20 at pivot 24. The lever 21, as specifically shown in FIG. 1, is pressed at one end by a coil spring 23 which is installed so as to adjust the spring pressure on the machine frame 20, and is biased to rotate in the counterclockwise direction. A stopper pin 25 is provided in the machine frame 20 in order to adjust and define the amount of counterclockwise motion of the lever 21.

In this embodiment, the upper feed dog 19 makes an ellipsoidal motion combining the horizontal motion and vertical motion by the oscillating motions of the cranks 13 and 14 for horizontal feed and vertical feed.

At the other end of the tubular shaft 12 and at a predetermined position of the oscillating shaft 11, the horizontal motion mechanism and the vertical motion mechanism furnished with an oscillating amount adjusting device and a changeover mechanism of oscillating range are respectively coupled. That is, at the other end of the tubular shaft 12, a bifurcate lever 6 is affixed, and a square slide piece 27 fitted within the bifurcate lever 6 is rotatably mounted on a slider 5 which is attached to a linear (i.e. a straight single arm) lever 4 pivotally supported on a fixed shaft 28 which is supported parallel to the oscillating shaft 11. An arc-shaped groove 31 of which a center of curvature is located on a straight line passing through the axis of the oscillating shaft 11 is formed in a upper part of a guide piece 32. The slider 5 rotatably supports a square piece 33 fitted in the arc-shaped groove 31 of the guide piece 32, which piece 32 has a bifurcate part in the lower side thereof fitted to the oscillating shaft 11. To the guide piece 32 for fitting the square piece 33 in the arc-shaped groove 31 formed at one side of the guide piece, an actuation lever 35 affixed to an operation shaft 34 supported rotatably on the machine frame parallel to the fixed shaft 28 is pivotally mounted at a position corresponding to the groove middle part on the opposite side, and the guide piece 32 straddling over the oscillating shaft 11 is moved up and down by the vertical motion of the actuation lever 35, and accordingly the slider 5 moves up and down on the lever 4, so that the bifurcate lever 6 coupled with the lever 4 is changed in the amount of oscillation.

Numeral 36 is an operation lever affixed to the projection end of the operation shaft 34 projecting from the sewing machine frame, and it is biased so as to always turn upward in the clockwise direction in the drawing by a spiral spring 43, and it is designed so that the operation lever 36 may be fixed on a mounting plate 37 by pinching the mounting plate from both sides by means of a holder 39 linked to the operation lever 36 through an arc-shaped groove 38 of the mounting plate 37 as mounted on the sewing machine frame, and the operation lever itself. The mounting plate 37 has an arc-shaped groove 40 disposed outside the arc-shaped groove 38, so that a pair of stopper screws 41 fixed at a proper position and being slidably fitted to the groove 40 may be fixed at an adjusted position by pinching the operation lever 36 above and below from both sides. On the mounting plate 37, furthermore, the outside of the arc-shaped groove 40 is formed in an arc shape, and graduations 42 to indicate the upper feed amount are provided along the edge.

Figure 4:
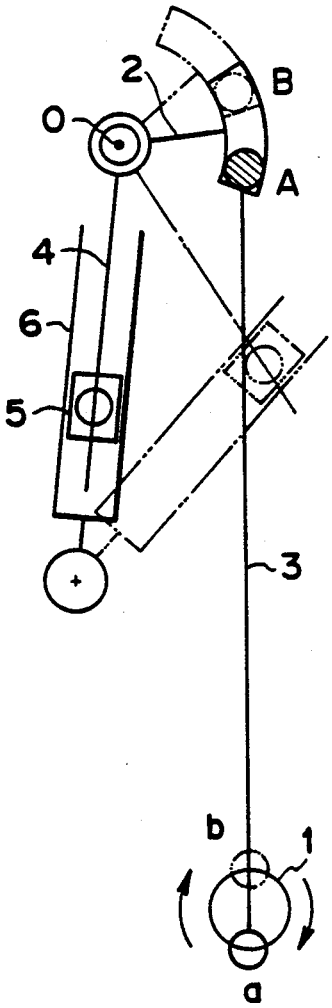
FIG. 4 is an operation diagram for the front upper feed.
Figure 5:
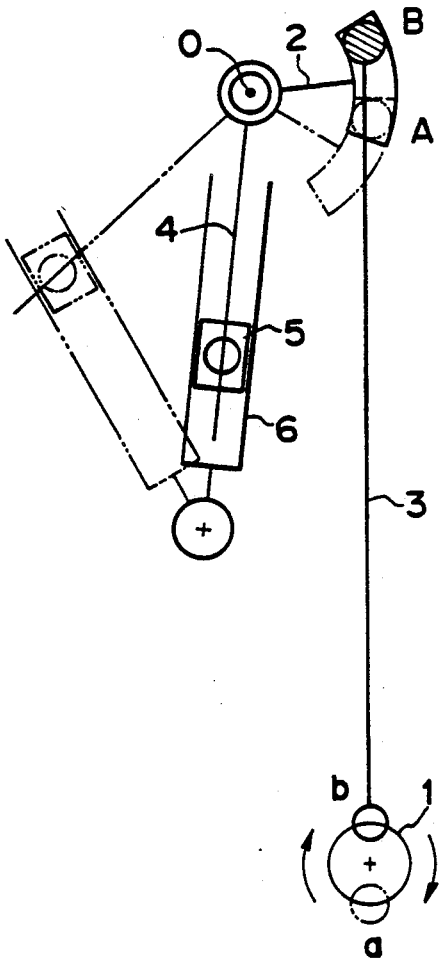
FIG. 5 is an operation diagram for the rear upper feed.

The lever 4 has also a one-body lever 2 projecting radially therefrom, and this lever has an arc-shaped groove 44 formed about the fixed shaft 28. A lower end of a rod 3 is coupled with an eccentric crank, provided on rotating main shaft 7 while the upper end of the rod 3 is coupled with the position of an upper end or lower end of the arc-shaped groove 44 by means of a pin 45 fixed to the lever 2 through the arc-shaped groove 44. Here, the pin 45, fixed to the lower end or upper end of the arc-shaped groove 44, is positioned on the line passing through the axis shaftline of the main shaft 7 in the state where the axial line of the lever 4 and the axial line of the bifurcate lever 6 are matched as shown in FIG 4 and FIG. 5. The distance between the lower end and upper end of the arc-shaped groove 44 is twice the eccentric amount of the eccentric crank 1.

The horizontal motion mechanism as thus composed, and in the state where the upper end of the rod 3 is pivotally mounted in the lower end of the arc-shaped groove 44 (point A in FIG. 4) by means of the pin 45, the eccentric crank 1 rotates a half turn in the clockwise direction from the bottom end point a as shown in FIG. 4, and when reaching the top end point b, the lever 4 and the bifurcate lever 6 have rotated from the solid line position to the single-dot chain line position. In consequence, when the eccentric crank 1 rotates a half turn from the top end point b to the bottom end point a, the lever 4 and bifurcate lever 6 return to the solid line position. Thus, by the rotation of the eccentric crank 1, the bifurcate lever 6 oscillates between the left end point indicated by solid line and the right end point indicated by single-dot chain line, and the upper feed bar cooperating therewith moves horizontally while the rear position is constant. When the upper feed dog for front upper feed is provided, the upper feed dog moves back and forth before the needle drop point while the rear position is constant.

When the upper end of the rod 3 is coupled with the upper end of the arc-shaped groove 44 (point B in FIG. 5), since the interval between A and B extends in a peripheral direction with respect to lever 2 and is twice the eccentric amount of the crank on the straight line passing through the center of rotation of the eccentric crank 1, that is, the length between a and b, the eccentric crank 1 begins to rotate from the top end point b, reversely to the case mentioned above, by changeover to the point B side and reaches the bottom end point a. As a result, the lever 2 and the bifurcate lever 6 turn reversely to the above case, that is, the bifurcate lever 6 turns in the counter-clockwise direction, from the solid line position to the double-dot chain line position. When the eccentric crank 1 rotates a half turn from the bottom end point a to the top end point b, the levers 4 and 6 return to the solid line position. In this way, by the rotation of the eccentric crank 1, the bifurcate lever 6 oscillates between the right end point indicated by solid line and the left end point indicated by double-dot chain line, and the upper feed bar cooperating therewith moves horizontally while the front position is constant. When the upper feed dog for rear upper feed is provided, the upper feed dog moves back and forth behind the needle drop point.

The upper feed amount is adjusted by adjusting the position of the slider 5 by controlling the operation lever 36.

For example, when the slider 5 is moved toward the free end of the lever 4, the oscillating amount of the bifurcate lever 6 increases, and to the contrary when moved toward the pivot of the lever 4, the oscillating amount of the bifurcate lever 6 decreases. As shown in FIGS. 4 and 5, if the slider 5 is moved toward the lever 4 in the matched state wherein the radial directions of the lever 4 and bifurcate lever 6 are aligned, the bifurcate lever 6 does not move, and when the position of the slider 5 is changed in the state shown in FIG. 4, the bifurcate lever 6 always oscillates by changing the oscillating amount in the rightward direction, with the left end point located at the solid line position. When the position of slider 5 is changed in the state shown in FIG. 5, on the other hand, even if the oscillating amount is changed in the leftward direction, the right end point remains located at the solid line position.

Thus, even if the upper feed amount is changed, the upper feed dog 9 does not collide against the presser foot because the rear position is unchanged in the front upper feed and the front position is unchanged in the rear upper feed.

In the horizontal motion mechanism described herein, points A and B are located on the straight line passing through the center of rotation of the eccentric crank 1, and their interval is set the same as the length between a and b, so that the oscillating range may be evenly distributed to right and left, but this is not limitative, and these points may not be necessarily located on the straight line passing through the center of rotation, and their interval may be somewhat longer than or shorter than the length between a and b. If different, however, it is necessary to determine the length of the component on the straight line shorter than the length between a and b (because it is not possible to change over if set longer than the length between a and b). In this case, by changeover between A and B, part of the oscillating range is overlapped.

Points A and B may be also, preferably, set at the same length from the center of oscillation o, and may be positioned on the same circumference or on different circumferences. If different, the right and left amplitudes (oscillating amounts) of the bifurcate lever 6 will be different.

Regarding the vertical motion mechanism coupled to the oscillating shaft 11, an actuation lever 51 is affixed to a tubular shaft 52 and the tubular shaft is fitted to the operation shaft 34 making up a double shaft structure together with the operation shaft 34, and an operation lever 53 affixed to the tubular shaft 52 for turning the actuation lever 51 is attached to a support plate 54 by means of a headed pin 56 fixed through an arc-shaped groove 55, and the structure is the same as that of the horizontal motion mechanism except that graduations 57 to indicate the vertical stroke are provided in the arc-shaped edge of the support plate 54. Therefore, the same reference numbers, with a "prime" designation, as in the horizontal motion mechanism refer to the identical structure.

In this mechanism, when the main shaft 1 rotates, the oscillating shaft 11 oscillates, the crank 14 for upper feed oscillates up and down, and the upper feed bar 15 and the upper feed dog 19 move up and down. The vertical stroke can be adjusted by operating the operation lever 52 to move the slider 5' along the lever 4', but the moving range differs between when the connecting point of the rod 3' and the lever 2' is positioned at the lower end of the arc-shaped groove 44' and when it is positioned at the upper end. In other words, when positioned at the lower end, it moves downward while the upper position is constant, and when positioned at the upper end, it moves upward while the lower position is constant.

Although the present invention is described above using a particular type of upper feed mechanism, it is by no means limited thereto and can be similarly applied to upper feed mechanisms which move horizontally through the coupling of the base end of an upper feed bar to a crank for horizontal feed and feed vertically by a crank for vertical feed and a spring for forcing down the upper feed bar, as well as to other conventional upper feed mechanisms.

I claim:

1. An upper feed mechanism of a sewing machine comprising an upper feed bar having an upper feed dog detachably mounted to one end thereof; a vertical motion mechanism for moving the upper feed bar up and down in conjunction with a main shaft; and a horizontal motion mechanism having a first lever which is pivoted oscillatably for moving the upper feed bar back and forth and adjusting an upper feed amount while a front or rear position of the upper feed dog is constant, said upper feed mechanism including a crank rotated and driven by the main shaft, a horizontal motion lever connected to said first lever and having two positions for coupling with the crank while the crank is at a top or bottom end point, and a rod having an upper and lower end, said lower end being coupled to said crank and said upper end being changeable over and pivotally linked by connecting means for horizontal motion to either one of said two positions of said horizontal motion lever.

2. An upper feed mechanism of a sewing machine according to claim 1 wherein the horizontal motion lever has an arc-shaped groove, an upper and lower end of which define said two positions of said horizontal motion lever.

3. An upper feed mechanism of a sewing machine comprising a main shaft; an upper feed bar having an upper feed dog detachably mounted to one end thereof; a vertical motion mechanism having a second lever which is pivoted oscillatably for moving the upper feed bar up and down and adjusting a vertical feed amount while a top or bottom position of the upper feed dog is constant; and a horizontal motion mechanism having a first lever which is pivoted oscillatably for moving the upper feed bar back and forth and adjusting an upper feed amount while a front or rear position of the upper feed dog is constant, said upper feed mechanism including a second crank rotated and driven by the main shaft, a vertical motion lever which is connected to the second lever and has two positions for coupling with the second crank while the second crank is at a top or bottom end point, a vertical motion rod having an upper and lower end, said vertical motion rod lower end being coupled to said second crank and said vertical motion rod upper end being changeable over and pivotally linked by connecting means for vertical motion to either one of said two positions of said vertical motion lever, a first crank rotated and driven by the main shaft, a horizontal motion lever which is connected to the first lever and has two positions for coupling with the first crank while the first crank is at a top or bottom end point, and a horizontal motion rod having an upper and lower end, said horizontal motion rod lower end being coupled to said first crank and said horizontal motion rod upper end comprising means for being changeable over and pivotally linked by connecting means for horizontal motion to either one of said two positions of said horizontal motion lever.

4. An upper feed mechanism of a sewing machine comprising an upper feed bar having an upper feed dog detachably mounted to one end thereof; a horizontal motion mechanism coupled to the upper feed bar for moving the upper fed bar back and forth by means of a main shaft; and a vertical motion mechanism for moving the upper feed bar up and down in conjunction with the main shaft, in which the upper feed dog is disposed before a needle drop point or behind the needle drop point, the horizontal motion mechanism including a crank lever mechanism composed of a crank rotated and driven by the main shaft, a lever pivoted oscillatably and having two positions in a peripheral direction with respect to the lever, and a rod for coupling the crank and lever, thereby oscillating the lever by the rotation of the crank, and a transmission mechanism for transmitting the oscillation of the lever to the upper feed bar, the transmission mechanism containing an adjusting device for adjusting the upper feed amount without moving the upper feed dog, and the rod of the crank lever mechanism being changeable over and linked by connecting means to either one of said two positions, said two positions having a defined interval, for coupling the crank while the crank is at a top or bottom end point depending on whether the upper feed dog is disposed before the needle drop point or behind the needle drop point, said horizontal and vertical motion mechanisms respectively possessing an oscillating shaft cooperating with the main shaft, one of the two oscillating shafts being a tubular shaft rotatably fitted onto the other shaft to make a double shaft structure.

5. An upper feed mechanism of a sewing machine according to claim 4, wherein the horizontal motion mechanism and vertical motion mechanism respectively are provided with an operational shaft which is rotated and operated manually or by a driving device, and one of the two operational shafts is a tubular shaft and is rotatably fitted on the other to make up a double shaft structure.

6. An upper feed mechanism of a sewing machine comprising an upper feed bar having an upper feed dog detachably mounted to one end thereof; a horizontal motion mechanism coupled to the upper feed bar for moving the upper feed bar back and forth by means of a main shaft; and a vertical motion mechanism for moving the upper feed bar up and down by means of the main shaft, in which the upper feed dog is disposed before a needle drop point or behind the needle drop point, and the horizontal and vertical motion mechanisms each respectively including a crank lever mechanism composed of a crank rotated and driven by the main shaft, a lever pivoted oscillatably and having two positions in a peripheral direction with respect to the lever, and a rod for coupling the crank and the lever, thereby oscillating the lever by rotation of the crank, and a transmission mechanism for transmitting the oscillation of the lever to the upper feed bar, each transmission mechanism containing an adjusting device for adjusting the upper feed amount or vertical feed amount without moving the upper feed dog, and the rod of each crank lever mechanism being changeable over and linked by connecting means to either one of said two positions, said two positions having a defined interval, for coupling the crank while the crank is at a top or bottom end point depending on whether the upper feed dog is disposed before the needle drop point or after the needle drop point, the upper feed amount and vertical feed amount adjusting devices respectively being provided with an operational shaft which is rotated and operated manually or by a driving device, one of the two operational shafts being rotatably fitted onto the other to make a double shaft structure.

7. An upper feed mechanism of a sewing machine according to claim 6 wherein the horizontal motion mechanism and vertical motion mechanism respectively possess an oscillating shaft cooperating with the main shaft, and one of the two oscillating shafts is a tubular shaft which is rotatably fitted on the other to make up a double shaft structure.

8. An upper feed mechanism of a sewing machine according to claim 14, wherein each operation shaft has an operating member attached to an end of said each operational shaft projecting outside the sewing machine.

* * * * *

UNITED STATES PATENT AND TRADEMARK OFFICE

CERTIFICATE OF CORRECTION

PATENT NO. : 4 987 843

DATED : January 29, 1991

INVENTOR(S) : Takashi KASUDA

It is certified that error appears in the above-identified patent and that said Letters Patent is hereby corrected as shown below:

On the title page, at item [54] change the title to read ---UPPER FEED ADJUSTING MECHANISM FOR SEWING MACHINE---.

Column 7, line 23; change "fed" to ---feed---.

Signed and Sealed this

Eighth Day of December, 1992

*Attest:*

*Attesting Officer*

DOUGLAS B. COMER

*Acting Commissioner of Patents and Trademarks*